United States Patent [19]

Morris

[11] 4,252,104

[45] Feb. 24, 1981

[54] SPACE HEATERS

[75] Inventor: William H. D. Morris, Malahide, Ireland

[73] Assignees: William John Robert Couchman; Charles Harold Simms, both of Ireland

[21] Appl. No.: 27,150

[22] Filed: Apr. 4, 1979

Related U.S. Application Data

[63] Continuation of Ser. No. 892,109, Mar. 31, 1978, abandon:d.

[51] Int. Cl.[3] ..... F24C 13/00

[52] U.S. Cl. ..... 126/5; 126/1 E; 126/34; 126/76

[58] Field of Search ..... 126/1 AD, 1 D, 1 E, 126/5, 34, 76

[56] References Cited

U.S. PATENT DOCUMENTS 70,077 10/1867 Dewey ..... 126/5

FOREIGN PATENT DOCUMENTS 223041 2/1943 Switzerland ..... 126/5
238818 12/1945 Switzerland ..... 126/5
120264 11/1947 Sweden ..... 126/286

*Primary Examiner*—Carroll B. Dority, Jr.
*Attorney, Agent, or Firm*—McGlew and Tuttle

[57] ABSTRACT

A space heater has a combustion chamber provided with hollow cheeks adapted for providing a supply of air into the combustion chamber at a level above the burner. The space heater incorporates a water boiler and a cooker unit which are arranged to be heated by combustion products in respective flues, each flue having a separate damper, whereby the flow of combustion products through each may be controlled individually.

6 Claims, 5 Drawing Figures

Fig. 3.
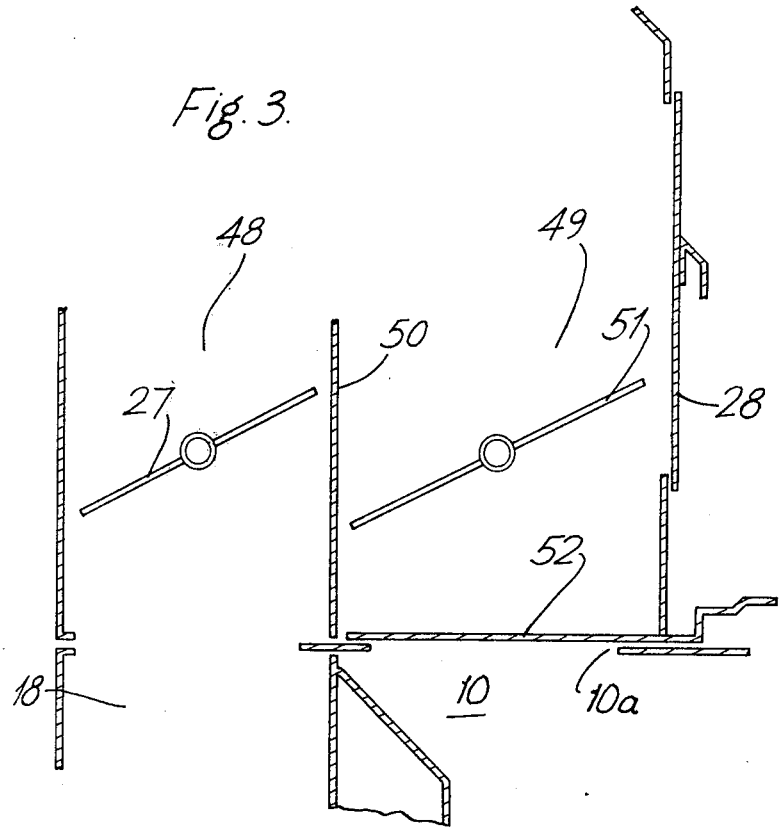
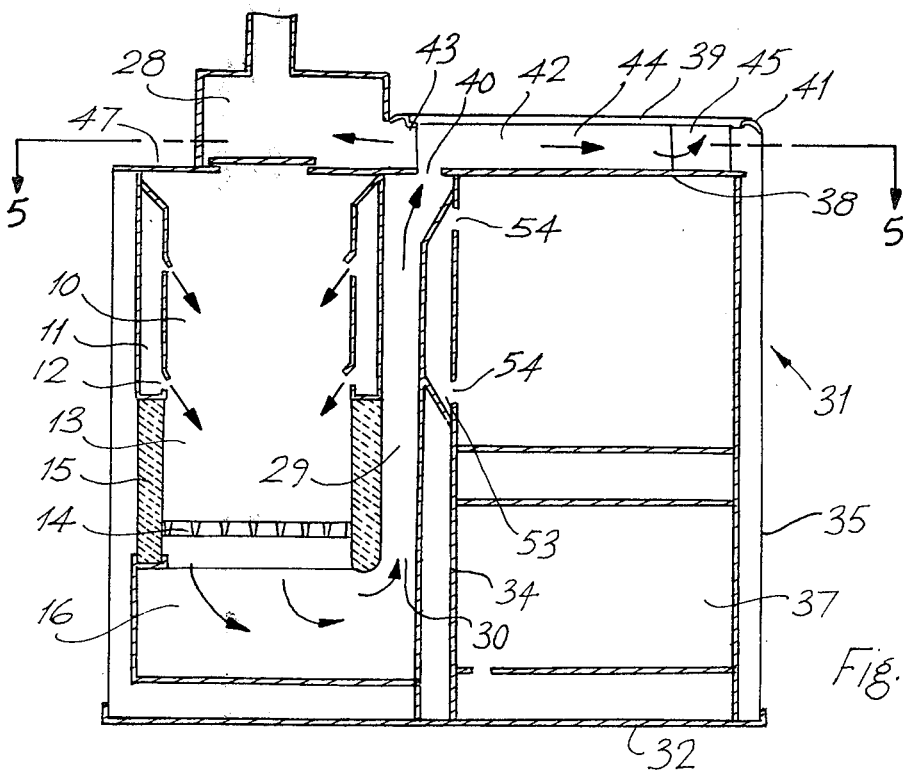
Fig. 2

SPACE HEATERS

This is a continuation of application Ser. No. 892,109 filed Mar. 31, 1978, now abandoned.

FIELD AND SUMMARY OF THE INVENTION

This invention relates to a space heater.

According to the present invention there is provided a space heater with a water boiler and a cooking unit comprising, a solid fuel combustion appliance including an upwardly elongated combustion chamber having fire bars at its lower end, for supporting a fire bed, a first flue for transferring heat to the water boiler and a second flue, in parallel with and adjacent to the first flue and the elongated combustion chamber for transferring heat to the cooking unit. The flues both have upstream ends positioned below the fire bars with the combustion chamber communicating with the upstream end of the flues by transverse paths in an ash pit area below the fire bars. The paths are provided for the gaseous products of combustion, along which, in normal use of the space heater, the gaseous products of combustion flow from the combustion chamber downwardly through the fire bed to a position below the fire bars. First and second dampers are operable to control the flow of the gaseous products of combustion through the first and second flues, respectively. The combustion chamber comprises upwardly elongated hollow side walls provided with an adjustable natural draft air inlet and with a plurality of downwardly directed spaced air outlets for discharging heated air downwardly and evenly into the combustion chamber above the fire bed offset from the natural air draft inlet.

The space heater is operated on solid fuel, e.g. coke or coal, and the lower part of the combustion chamber is lined with, refractory bricks and an ash pit is provided below the combustion chamber. A secondary air supply is preferably provided which is fed to a space below the fire bars.

For an understanding of the principles of the invention, reference will now be made to a typical embodiment thereof as illustrated in the accompanying drawings.

BRIEF DESCRIPTION OF THE DRAWINGS

FIG. 2 is a front view, in vertical section, of the combination heater of FIG. 1;

FIG. 3 is a part sectional view on the line III—III of FIG. 5;

Figure 1:
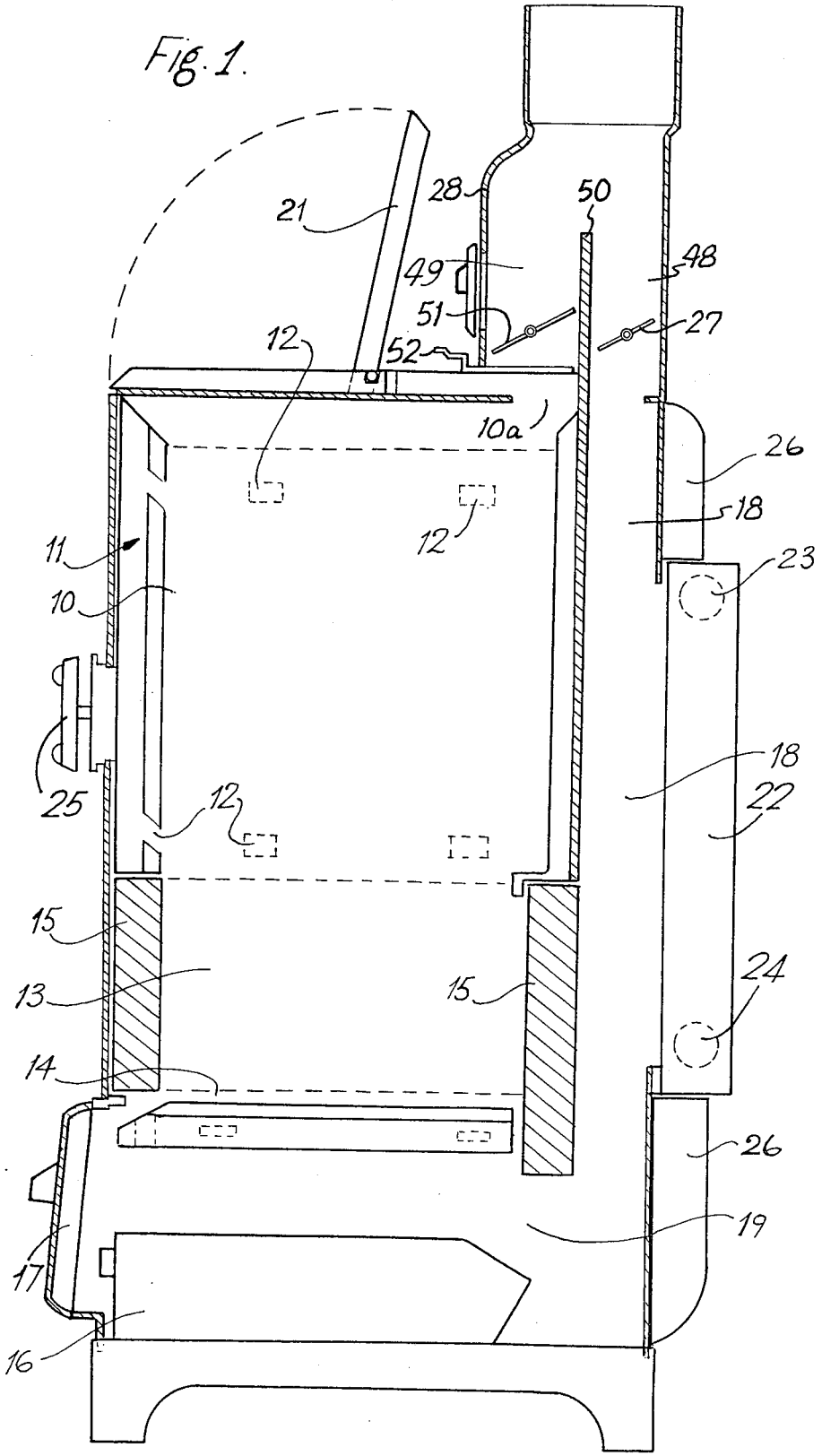
FIG. 1 is a left-hand side view in partial section, of a combined space heater, water heater and cooker unit according to the invention.
Figure 4:
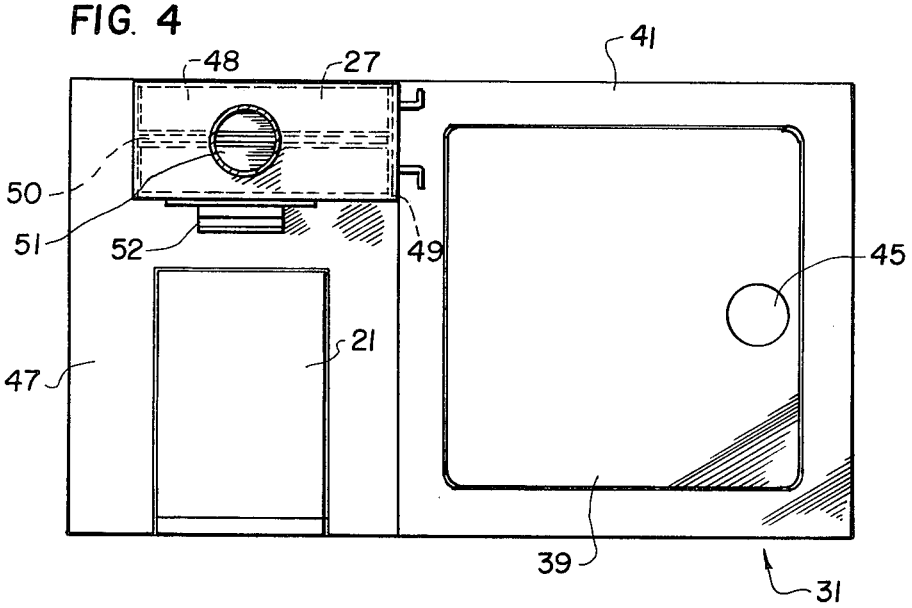
FIG. 4 is a plan view of the combination heater of FIG. 1.
Figure 5:
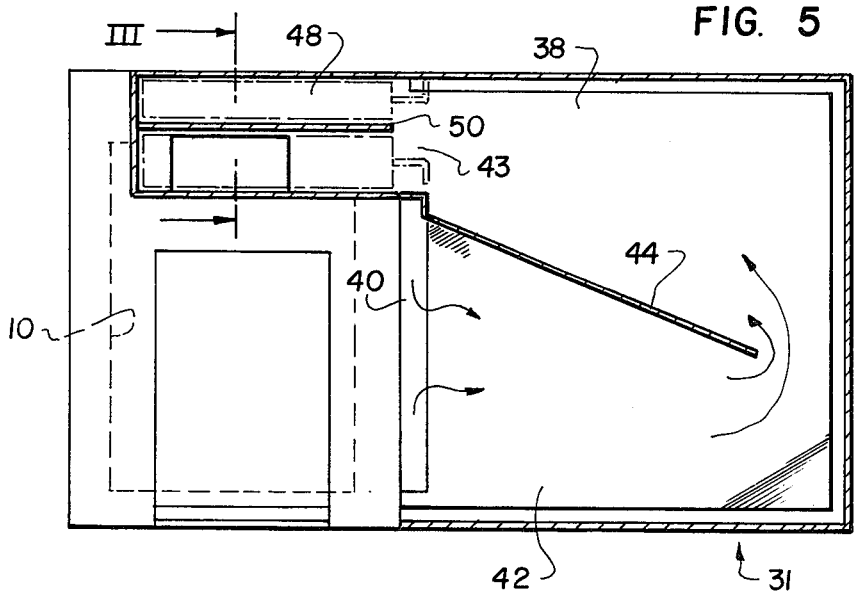
FIG. 5 is a sectional plan view of the combination heater of FIG. 1 showing the direction of flow of combustion gases.

Referring to the drawings, the combination heater there shown incorporates a combustion appliance which is adapted to heat a water boiler to provide a hot water supply as well as to heat air for space heating and for cooking. The heater comprises a cast iron combustion chamber having hollow side cheeks or upwardly elongated hollow side walls 11 with a plurality of openings or downwardly directed air outlets 12 into the combustion chamber. The lower part of the combustion chamber 10 is provided with fire bars 14 and a refractory brick lining 15 supporting a fire bed 13. A conventional ash pit bin 16 is provided beneath the fire bars 14 and access to the ash pit bin 16 is provided through an ash pit door 17.

A first flue 18 open to atmosphere is provided which is open at its bottom or upstream end 19 to the ash pit area beneath the fire bars 14.

A fueling lid 21 is provided at the top of the combustion chamber 10. A water boiler 22 is provided beside the flue 18, the boiler 22 having conventional tappings 23 and 24. On the exterior surface of the heater there is provided a plurality of cooling fins 26 which serve to heat air for space heating purposes.

An adjustable air inlet 25 is provided which allows air to flow in a controlled manner into the hollow side cheeks 11 and thence, following heating in said side cheeks 11, to flow into the combustion chamber 10.

It will be readily understood that the supply of air—primary air—from the hollow side cheeks 11 enters the combustion chamber 10 above the firebed 13, and due to the location of the openings 12 the distribution of the primary air is dispersed around the sides of the combustion chamber 10. The interior surfaces of the combustion chamber 10 may be ribbed and/or grooved to improve mixing of the primary air at different levels in or above the firebed 13.

A secondary air supply is available to the firebed 13 under natural draught from the ash pit area. The secondary air supply comprises one or more air inlets 17*a* in the perimeter of the ash pit area. It is to be understood, however, that in this construction of space heater the primary air control means 25 allows air only into the hollow side cheeks 11 and hence to the combustion chamber 10 through the openings 12.

The flue 18 which is located at the rear of the combustion chamber 10 is open to atmosphere at its upper end and is open to the ash pit area 16 at its bottom end.

Gas flow in the flue 18 is controlled by means of a boiler or first damper 27 mounted in a smokehood 28. The boiler damper 27 has a cut-out portion to prevent full closure of the flue 18. An oven or second flue 29 is provided at one side of the combustion chamber 10, the oven flue 29 being open at its bottom or upstream end 30 to the ash pit area 16.

The cooker unit comprises an oven/hotplate assembly indicated generally at 31 and is located adjacent the flue 29. This assembly 31 comprises a base plate 32 with an upstanding edge which is adapted to receive and locate a front plate and a rear plate (not shown) and side plates 34 and 35 of the oven/hotplate assembly 31. The oven/hotplate assembly 31 comprises a main oven 36, a smaller lower oven 37 and a hotplate 39. The rear plate is extended sideways to form a rear ball for the oven flue 29 and separate it from flue 18. Similarly an oven top plate 38 extends sideways to enclose the oven flue 29 and is provided with a rectangular opening 40, approximately 11"×2½", which, in use, admits hot gases to the front section of a space 42 at the underside of the hot plate 39. The hot plate 39 is disposed over the oven top plate 38. As described below, the front section is defined on one side by a vertical wall 44. A ⅜" gap between the hotplate 39 and a cooker top plate 41 is sealed by woven asbestos rope. The space 42 between the oven top plate 38 and the hotplate 39 is 2½" deep and is closed all round by a vertical wall except for a gas outlet 43 which gives access to the smokehood 28.

The vertical wall 44 divides the space 42 into two sections, a front section and a rear section, along most of its major axis. A cleaning plug is provided at 45 in the hotplate where the wall 44 terminates and where, in use, the gases change direction through 180° and return through the rear section. The cooker top plate 41 locates and secures the top edges of the front plate, the rear plate and the side plates 34 and 35 of the oven/hotplate assembly 31. A metal closure plate (not shown) is provided and is hinged in conventional manner to the cooker top plate 41 at its rear, the metal closure plate being adapted to enclose the entire top of the oven/hotplate assembly 31 and to serve as a splash-back when open. When open the metal closure plate may be held in an upright position by means of a detent fitted to the smokehood 28. The front plate carries two oven doors, of which the upper is thermally insulated and is provided with a thermometer. The front plate is extended at one side to enclose the front of the oven flue 29 and to form a joint with the combustion chamber 10. The part of the front plate which encloses the oven flue 29 is provided with a layer of suitable rigid thermally insulating material.

The left-hand side of the combustion chamber 10 as viewed in FIG. 2 consists of a steel plate which has a 1" layer of mineral fibre thermally insulating material adjacent the inwardly-facing surfaces of the steel plate. A ½" layer of rigid insulating material is provided between the layer of mineral fibre and the steel plate of the combustion chamber 10. The side of the combustion chamber 10 adjoining the oven/hotplate assembly 31 is also provided with a ½" layer of rigid thermally insulating material.

The smokehood 28 is mounted on the combustion chamber 10 above its top plate 47 and has a rear section 48 and a front section 49 separated from each other by a vertical wall 50. A rear section 48 of the smokehood 28 surmounts the boiler flue 18 and the boiler damper 27 is situated in the section 48 and rotates about the major axis of the section. The front section 49 of the smokehood 28 communicates with outlet 43 and the opening 10*a*. A rotary oven or second damper 51 mounted in the smokehood 28 controls the flow of gases in the oven flue 29. A sliding damper 52 controls the opening 10*a* and determines whether the gases from the combustion chamber 10 pass directly into the front section 49 or whether the gases pass downwardly through the fire bed in the flues 18 and 29. Normally, the damper 52 is closed as shown in FIG. 3.

The smokehood 28 has a short extension at the side nearest the oven/hotplate assembly 31, which extension connects with the gas outlet 43 from the hotplate 39. By bolting this extension to the cooker top plate 41 and by using one connecting bolt or clip at the level of the base plate 32 secures the combustion chamber 10 and the oven/hotplate assembly are secured together.

In operation with the sliding damper 52 in its closed position and the dampers 27 and 51 open, down-firing occurs in the combustion chamber 10. Hot gases pass from the chamber 10 into the flues 18 and 29. Hot gases in the oven flue 29 heat the small lower oven 37 by limited conduction. Hot gases heat cheeks 53 located in the side plate 34 of the main oven 36, by conduction. Within the oven 36, hot air, heated by convection, circulates by way of a plurality of openings 54 and in this way the centre of the main oven 36 is heated. Hot gases in the flue 29 then rise through the opening 40 and pass through the front section of space 42 between the hotplate 39 and the top plate 38, turn through 180° at the end of the wall 44, and then return through the rear section of the space 42 to be discharged into the smokehood 28, upstream of the dampers 1 by way of the gas outlet 43. When the sliding damper 52 and the oven damper 51 are closed, hot gases enter the boiler flue 18 preferentially. The fact that the oven damper 51 may be completely closed, coupled with the presence of rigid thermally insulating material at the side of the combustion chamber 10 nearest the oven/hotplate assembly, means that the aforesaid assembly 31 may be virtually cut off from the source of heat. The flow of hot gases to the boiler may be controlled by virtue of the rotary damper 27, however this damper 27 cannot completely close the section 48 since it has a cut-out portion. Hence boiler output will always be sufficient to maintain a supply of domestic hot water.

The advantages of this arrangement include the capacity to reduce boiler output to the minimum required for domestic hot water while maintaining satisfactory oven and hotplate temperatures and the capacity to use the boiler independently of the oven/hotplate assembly, such that full boiler output may be attained as desired without necessarily supplying heat to the oven/hotplate assembly.

The combination heater also has the great advantage that the combustion chamber of the above embodiment normally operates on the principle of downfiring, wherein volatile materials resulting from the incomplete combustion of fuel may be prevented from escaping from the combustion chamber 10 directly into the flue through the opening 10*a*. Instead, by closing the damper 52 the volatile materials must leave the combustion chamber by way of the fire bed and ash pit area and then pass to the flue 18 and/or flue 29 and into the smoke box 28 and accordingly are more extensively burned, thereby resulting in a more efficient use of the fuel employed in the combustion chamber. This system of combustion permits a greater depth of fuel above the barebars 14 in addition to bringing about a more efficient use of the fuel. Down-firing in the combustion chamber is assisted and improved by the pre-heating of primary air within the hollow side cheeks 11 which distribute the air around and at different levels within the combustion chamber, by means of the downwardly inclined openings 12.

While a specific embodiment of the invention has been shown and described in detail to illustrate the application of the principles of the invention, it should be understood that the invention may be embodied otherwise without departing from such principles.

What we claim is:

1. A space heater with a water boiler (22) and a cooker unit (31), comprising: a solid fuel combustion appliance including an upwardly elongated combustion chamber (10) having firebars (14) at its lower end, for supporting a fire bed (13); a first flue (18), for transferring heat to the water boiler (22), and a second flue (29), in parallel with and adjacent said first flue and said elongated combustion chamber for transferring heat to the cooker unit (31); said flues both having upstream ends positioned below said firebars; said combustion chamber communicating with the upstream end of said flues by transverse paths in an ash pit area (16) below said firebars, for the gaseous products of combustion, along which, in normal use of the space heater, the gaseous products of combustion flow from the combustion chamber downwardly through said fire bed to a position below said fire bars; first (27) and second (51) dampers operable to control the flow of the gaseous products of combustion through said first and second flues, respectively; said combustion chamber (10) comprising upwardly elongated hollow side walls (11) provided with an adjustable natural draft air inlet (25) and with a plurality of downwardly directed spaced air outlets (12) for discharging heated air downwardly and evenly into said combustion chamber above said fire bed (13) offset from said natural air draft inlet.

2. A space heater according to claim 1, in which said first (18) and second (29) flues have respective downstream ends discharging, respectively, into first and second sections of a common smokebox (28), said first and second sections being separated from each other by a partition (50).

3. A space heater according to claim 2, in which said combustion chamber has a top wall (47) formed with an opening communicating with said second section of said smokebox; and a third damper controlling said opening.

4. A space heater according to claim 1, including means (**17*a***) for supplying air to said position below said fire bars.

5. A space heater according to claim 1, formed with heat-radiating fins (26) on its outer surface.

6. A space heater according to claim 1, in which said cooker unit comprises at least one oven (37) and a hot plate (39).

* * * * *